US005690598A

United States Patent [19]

Liang

[11] Patent Number: 5,690,598

[45] Date of Patent: Nov. 25, 1997

[54] WRIST EXERCISER

[76] Inventor: Yung Jen Liang, No. 76, An Ler Street, An Dong Tsuen, Hsue Hsai Hsiang, Chang Hua Hsien, Taiwan

[21] Appl. No.: 720,095

[22] Filed: Sep. 27, 1996

[51] Int. Cl.[6] ..... A63B 21/02; A63B 21/045

[52] U.S. Cl. ..... 482/127; 482/121; 482/45

[58] Field of Search ..... 482/44, 45, 49, 482/50, 108, 127, 128

[56] References Cited

U.S. PATENT DOCUMENTS

| | | | |
|---|---|---|---|
| 881,438 | 3/1908 | Nohl | 482/50 |
| 1,308,259 | 7/1919 | Sandow | 482/50 |
| 4,805,899 | 2/1989 | Roehlk | 482/127 |
| 5,033,740 | 7/1991 | Schwartz | 482/108 |

FOREIGN PATENT DOCUMENTS

| | | | |
|---|---|---|---|
| 901559 | 7/1945 | France | 482/128 |

*Primary Examiner*—Jerome Donnelly
*Assistant Examiner*—Denise Pothier
*Attorney, Agent, or Firm*—Charles E. Baxley, Esq.

[57] ABSTRACT

An exerciser includes one handle having an inner thread formed in one end and includes another handle having a bolt extended from one end for engaging with the inner thread of the one handle and for allowing the two handles to be rotated relative to the other. A spring is engaged on the bolt and biased between the handles for applying a biasing force against the handles and for resisting the rotation between the handles. A cap or one or more weights may be attached to the other end of each of the handles for exercising the arms of the user.

3 Claims, 6 Drawing Sheets

WRIST EXERCISER

BACKGROUND OF THE INVENTION

1. Field of the Invention

The present invention relates to an exerciser, and more particularly to an exerciser for exercising the wrist portion of the user.

2. Description of the Prior Art

Typical dumbbells are provided for exercising the upper muscle groups only and may not be used for exercising the wrist portion of the user.

The present invention has arisen to mitigate and/or obviate the afore-described disadvantages of the conventional exercisers.

SUMMARY OF THE INVENTION

The primary objective of the present invention is to provide an exerciser for exercising the wrist portion of the user.

In accordance with one aspect of the invention, there is provided an exerciser comprising a first handle including a first end having an inner thread formed therein and including a second end, a second handle including a first end having a bolt extended therefrom for engaging with the inner thread of the first handle and for allowing the second handle to be rotated relative to the first handle, the second handle including a second end, and means biasing between the first handle and the second handle for applying a biasing force against the first handle and the second handle and for resisting the rotation of the second handle relative to the first handle.

The first handle includes a first stud formed on the second end thereof and includes a first cap secured on the first stud. The second handle includes a second stud formed on the second end thereof and includes a second cap secured on the second stud.

The first handle includes at least one first weight secured to the second end of the first handle, and the second handle includes at least one second weight secured to the second end of the second handle.

The biasing means includes a spring engaged on the bolt and biased between the first handle and the second handle for applying the biasing force against the first handle and the second handle.

Two cones are rotatably engaged on the bolt, the spring includes two ends engaged with the cones.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
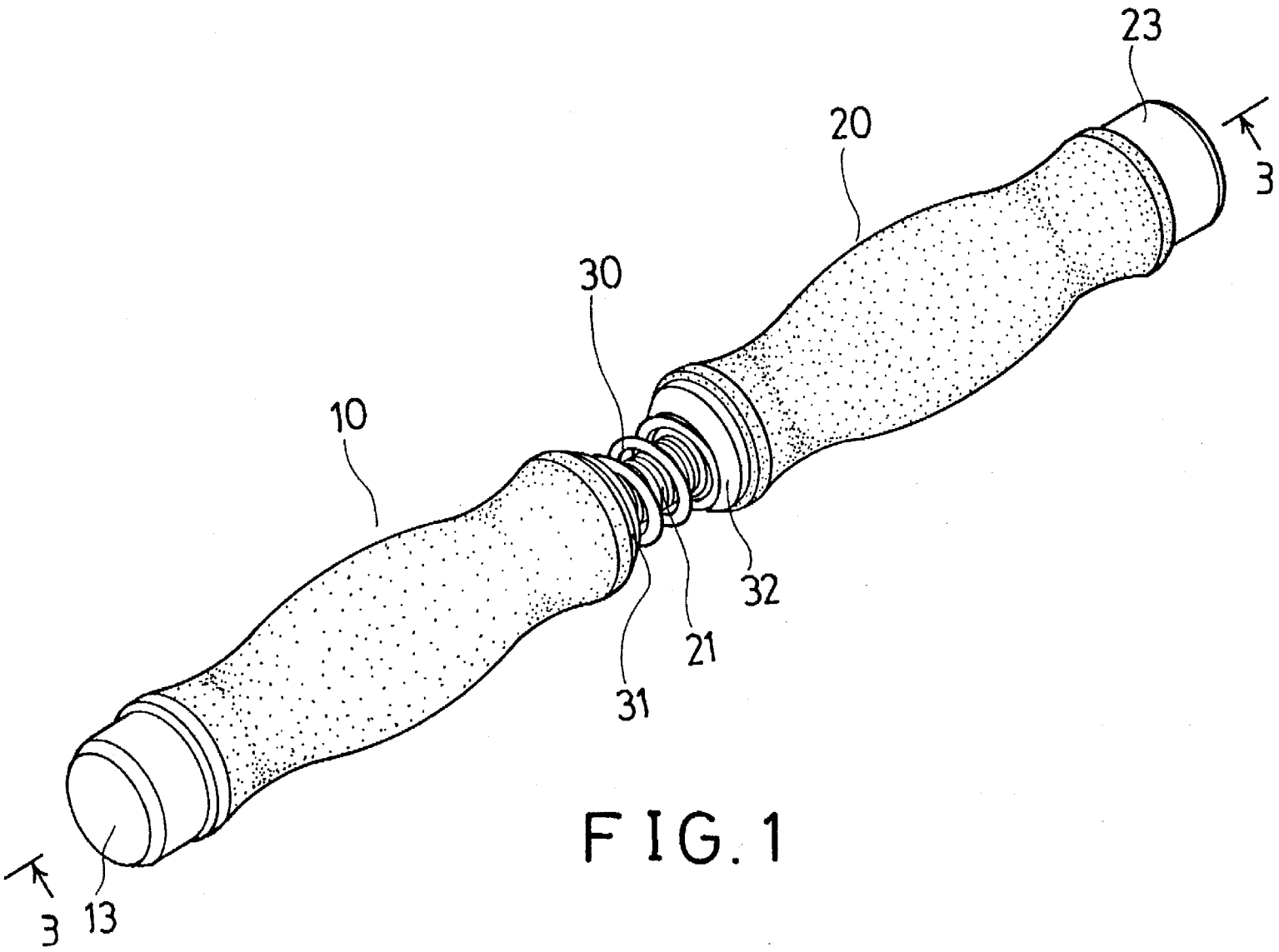
FIG. 1 is a perspective view of a wrist exerciser in accordance with the present invention.
Figure 2:
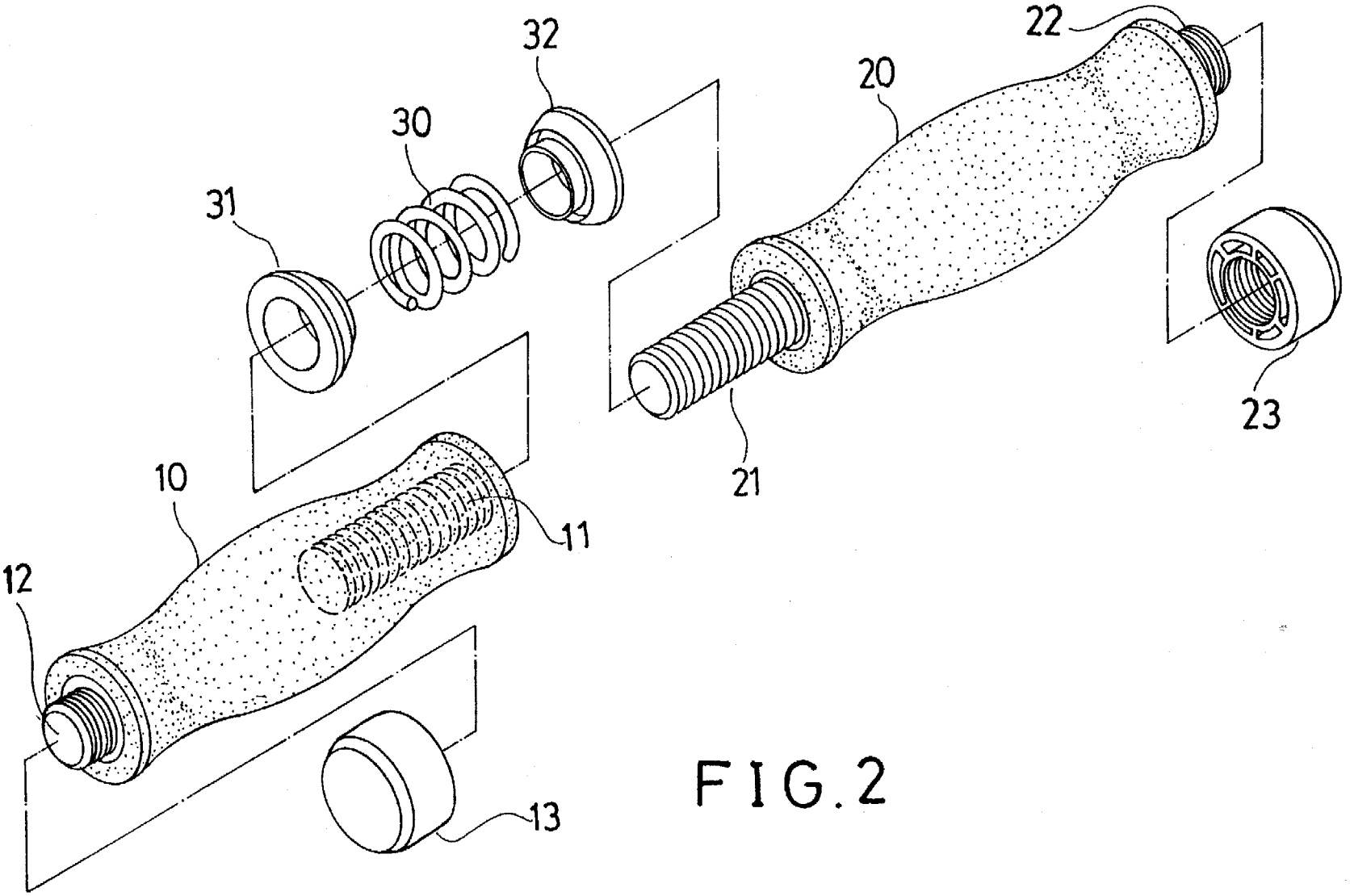
FIG. 2 is an exploded view of the wrist exerciser.
Figure 3:
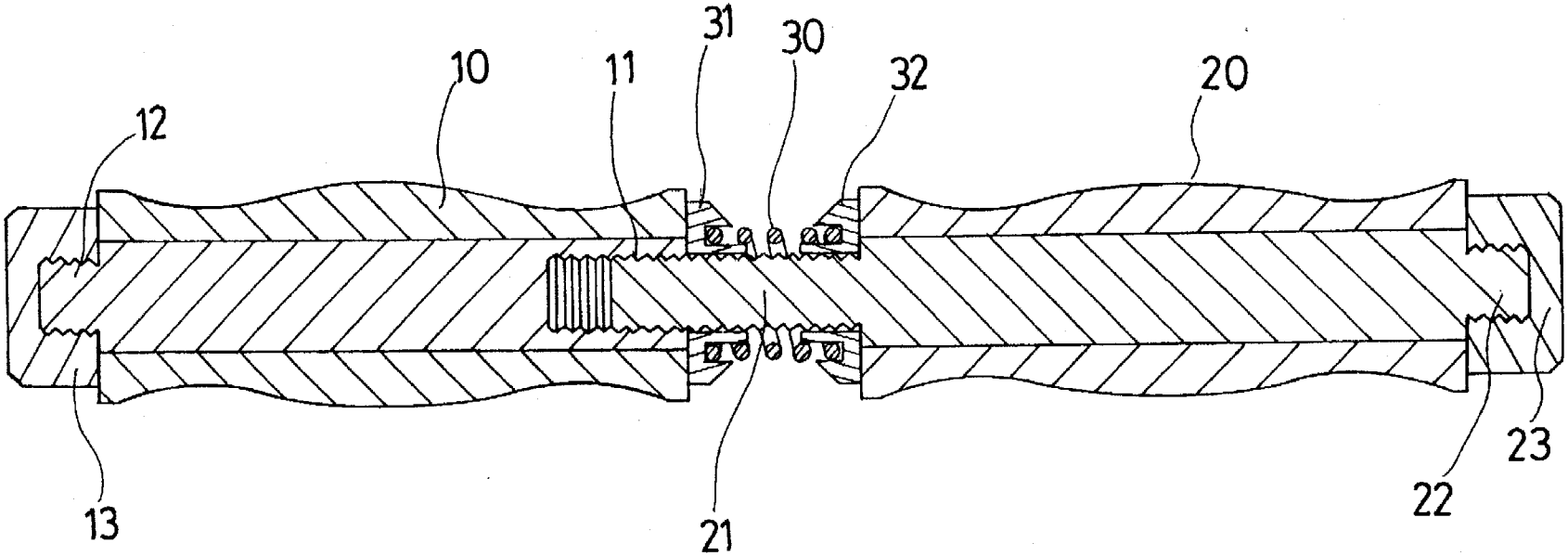
FIG. 3 is a cross sectional view taken along lines 3—3 of FIG. 1.

Referring to the drawings, and initially to FIGS. 1 to 4, a wrist exerciser in accordance with the present invention comprises a first handle 10 including an inner thread 11 formed in one end and including a stud 12 having an outer thread formed thereon for engaging with a cap 13. A second handle 20 includes a bolt 21 extended therefrom for tbreadedly engaging with the inner thread 11 of the first handle 10 and includes a stud 22 having an outer thread formed thereon for engaging with a cap 23. Two cones 31, 32 are rotatably engaged on the bolt 21. A spring 30 is engaged on the bolt 21 and engaged between the cones 31, 32 for applying a biasing force against the handles 10, 20.

Figure 4:
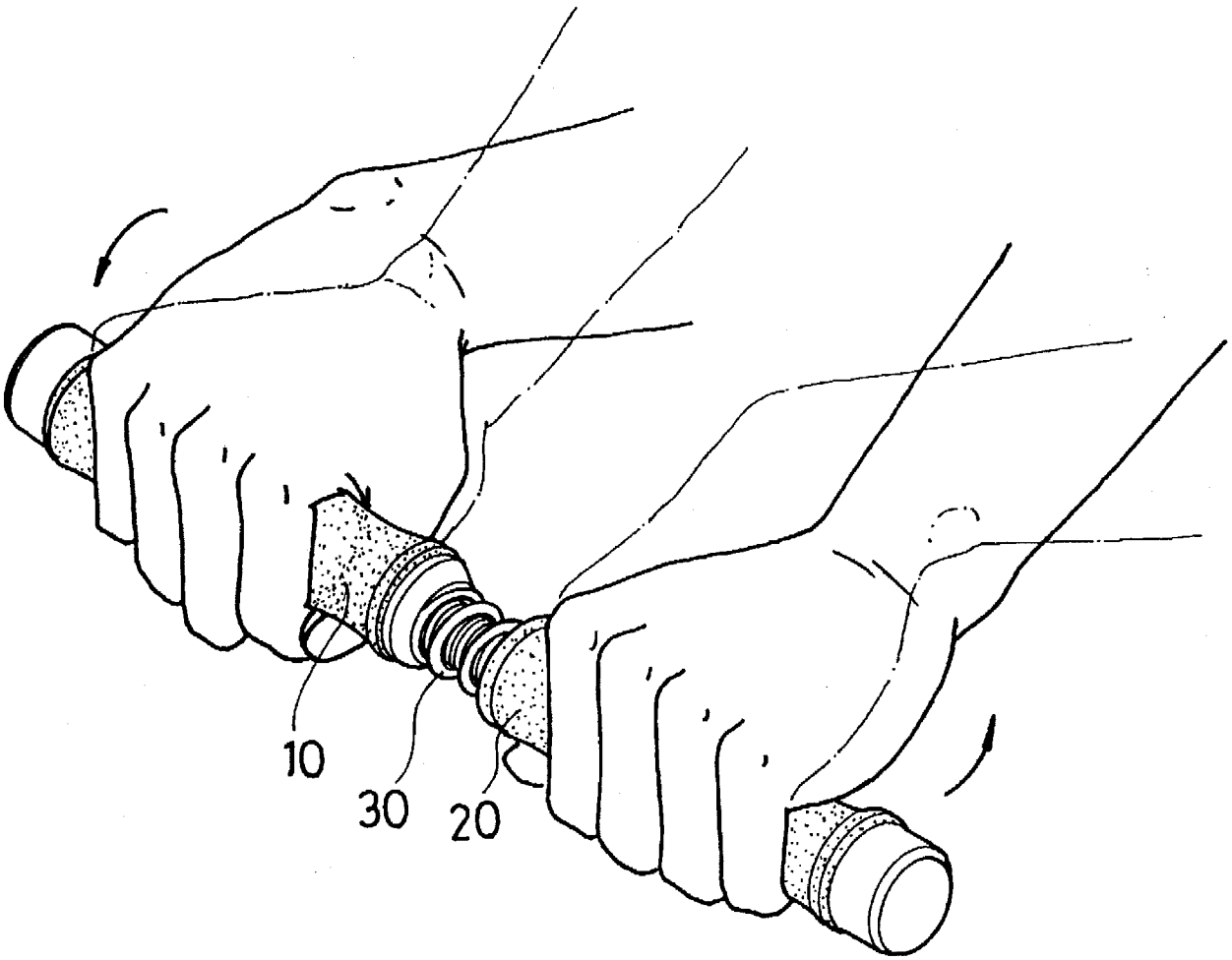
FIG. 4 is a perspective view illustrating the operation of the wrist exerciser.

In operation, as shown in FIG. 4, the handles 10, 20 may be rotated one relative to the other by the hands of the user against the spring force of the spring 30 so as to exercise the wrist portion of the user. It is to be noted the spring 30 may apply a greater biasing force against the handles 10, 20 when the handles 10, 20 are threaded toward each other. 0n the contrary, the spring 30 may apply a smaller biasing force against the handles 10, 20 when the handles 10, 20 are threaded away from each other.

Figure 5:
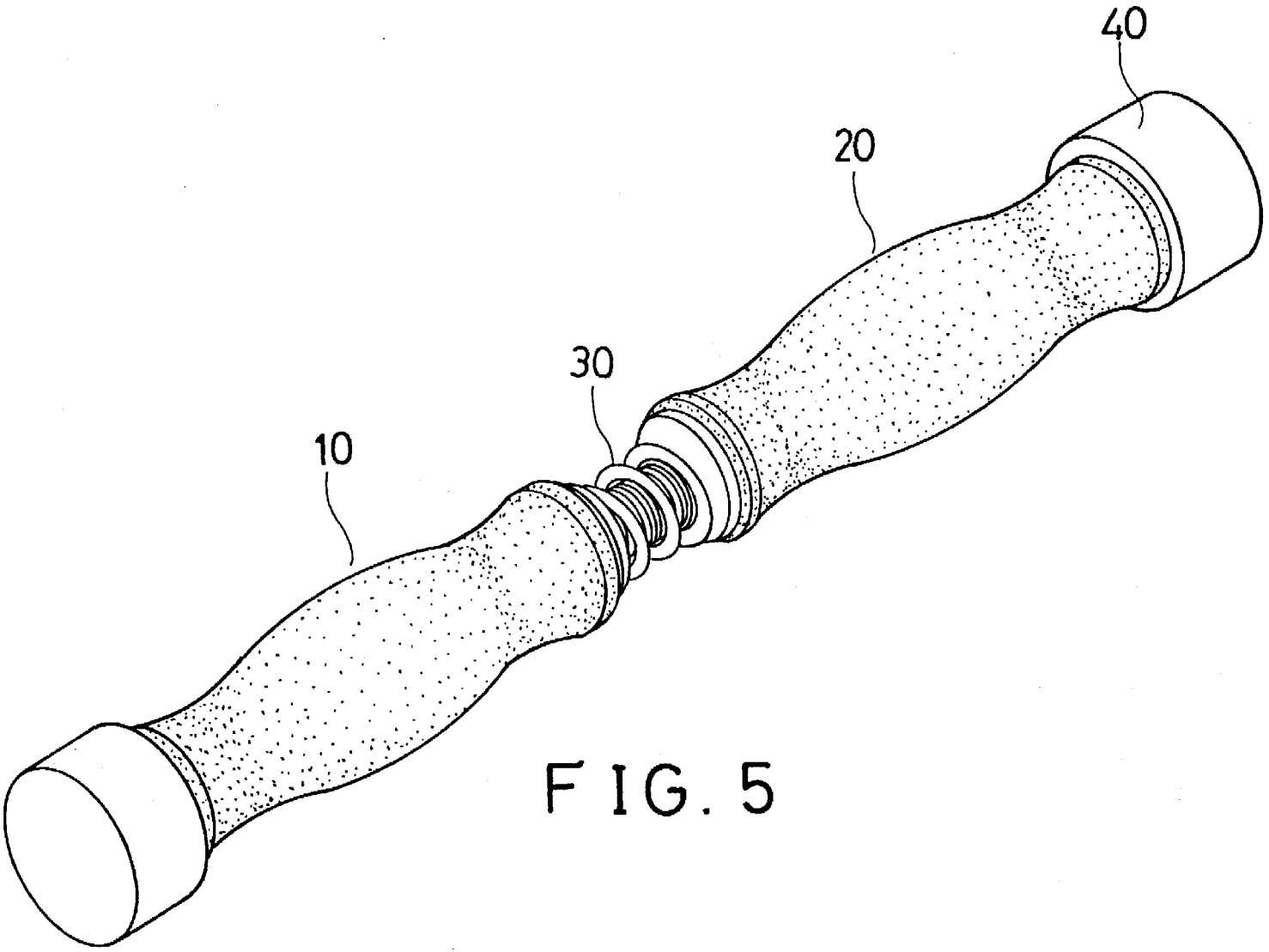
FIGS. 5 and 6 are perspective views illustrating the applications of the wrist exerciser.
Figure 6:
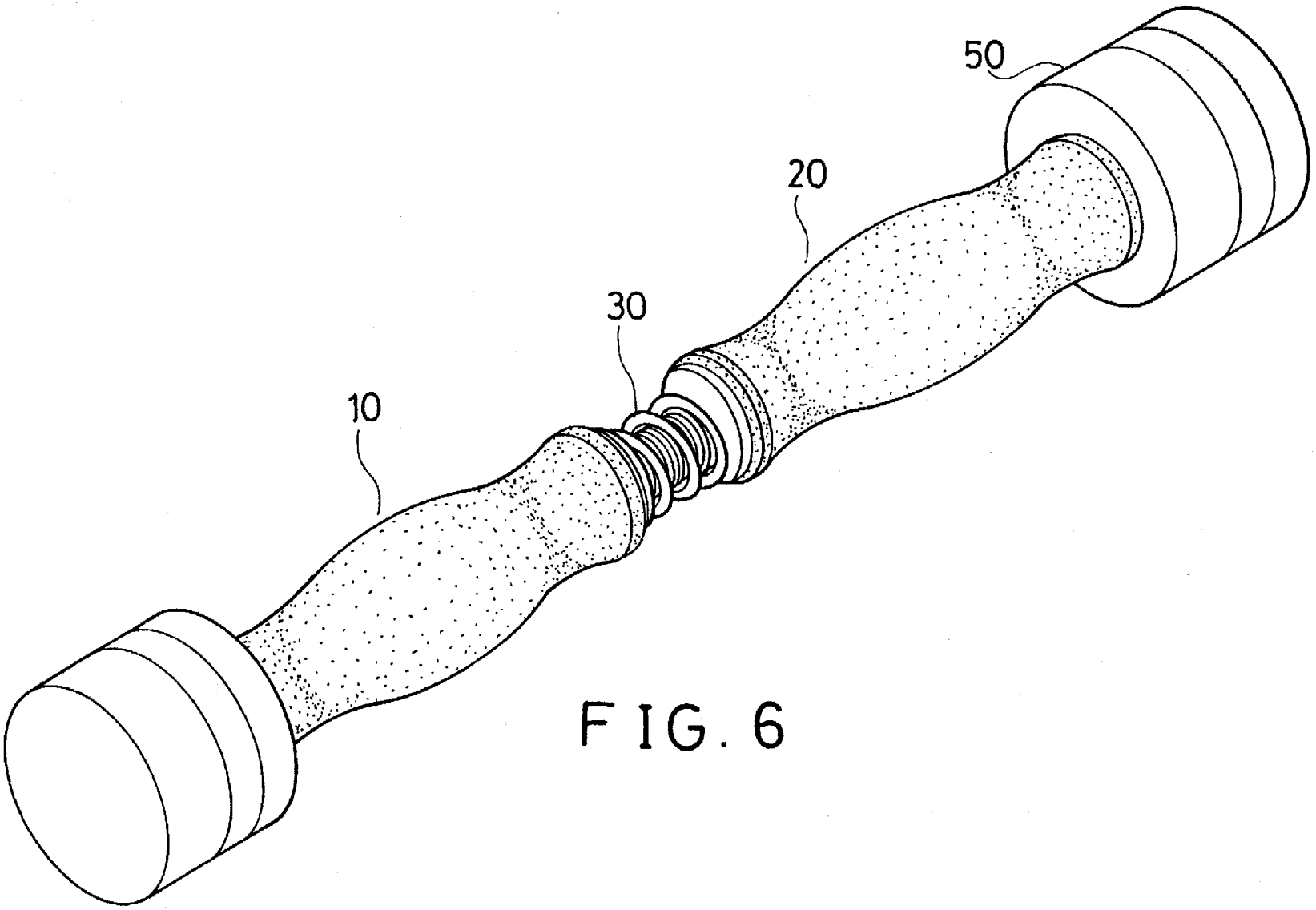

Referring next to FIGS. 5 and 6, one weight 40 (FIG. 5) or more weights 50 (FIG. 6) may be secured to the handles 10, 20 at the studs 12, 22 for increasing the weight of the exerciser and for exercising the muscle groups of the arms of the user.

Accordingly, the wrist exerciser in accordance with the present invention includes a pair of handles that may be rotated one relative to the other for exercising the wrist portion of the user. In addition, one or more weights may be added to the exerciser for exercising the arms of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a first handle including a first end having an inner thread formed therein and including a second end, a second handle including a first end having a bolt extended therefrom for engaging with said inner thread of said first handle and for allowing said second handle to be rotated relative to said first handle, said second handle including a second end, two cones rotatably engaged on said bolt, and means biasing between said first handle and said second handle for applying a biasing force against said first handle and said second handle and for resisting the rotation of said second handle relative to said first handle, said biasing means including a spring engaged on said bolt and biased between said first handle and said second handle for applying the biasing force against said first handle and said second handle, said spring including two ends engaged with said cones.

2. An exerciser according to claim 1, wherein said first handle includes a first stud formed on said second end thereof and includes a first cap secured on said first stud, said second handle includes a second stud formed on said second end thereof and includes a second cap secured on said second stud.

3. An exerciser according to claim 1, wherein said first handle includes at least one first weight secured to said second end of said first handle, and said second handle includes at least one second weight secured to said second end of said second handle.

* * * * *